US009638038B2

(12) United States Patent
Duesler et al.

(10) Patent No.: US 9,638,038 B2
(45) Date of Patent: May 2, 2017

(54) DMZ FRACTURE BOUNDARY LIMIT

(71) Applicant: UNITED TECHNOLOGIES CORPORATION, Farmington, CT (US)

(72) Inventors: Paul D. Duesler, Manchester, CT (US); Paul Filewich, Salem, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 768 days.

(21) Appl. No.: 13/738,444

(22) Filed: Jan. 10, 2013

(65) Prior Publication Data

US 2014/0193267 A1 Jul. 10, 2014

(51) Int. Cl.

| | |
|---|---|
| ***F01D 5/12*** | (2006.01) |
| ***F01D 5/14*** | (2006.01) |
| ***F01D 5/00*** | (2006.01) |
| *C21D 10/00* | (2006.01) |
| *C21D 11/00* | (2006.01) |

(52) U.S. Cl.

CPC ..... *F01D 5/12* (2013.01); *F01D 5/005* (2013.01); *F01D 5/141* (2013.01); *C21D 10/005* (2013.01); *C21D 11/00* (2013.01); *F05D 2260/80* (2013.01); *F05D 2260/81* (2013.01); *F05D 2260/94* (2013.01); *Y10T 29/49231* (2015.01)

(58) Field of Classification Search

CPC . F01D 5/12; F01D 5/141; F01D 5/005; F01D 5/288; F01D 5/286; F05D 2260/94; F05D 2260/941; F05D 2230/80; F05D 2230/90; F05D 2240/303; F05D 2240/31

IPC ..... F01D 5/005,5/12, 5/141

See application file for complete search history.

(56) References Cited

U.S. PATENT DOCUMENTS 5,531,570 A * 7/1996 Mannava ..... B23P 9/00 219/121.65
5,756,965 A 5/1998 Mannava
5,988,982 A * 11/1999 Clauer ..... C21D 10/005 219/121.62
6,075,593 A 6/2000 Trantow et al.

(Continued)

FOREIGN PATENT DOCUMENTS

EP 1138431 A2 10/2001

OTHER PUBLICATIONS

International Search Report and Written Opinion for related International Application No. PCT/US2013/068718; report dated Aug. 12, 2014.

(Continued)

*Primary Examiner* — Craig Kim
*Assistant Examiner* — Brian P Wolcott
(74) *Attorney, Agent, or Firm* — Cantor Colburn LLP

(57) ABSTRACT

A method of establishing a boundary for a material improvement process on a workpiece is disclosed. The method may include identifying a maximum allowable damage depth on the workpiece; identifying a maximum constant thickness line on the workpiece at an extent of the maximum allowable damage depth; identifying a peak vibratory stress gradient on the workpiece; identifying a peak combined engine stress on the workpiece; and specifying the boundary for the material improvement process on the workpiece relative to the maximum constant thickness line, peak vibratory stress gradient, and peak combined engine stress.

17 Claims, 4 Drawing Sheets

(56) References Cited

U.S. PATENT DOCUMENTS

| | | | | |
|---|---|---|---|---|
| 7,217,102 | B2 | 5/2007 | Rockstroh et al. | |
| 7,384,244 | B2 * | 6/2008 | Broderick | B23P 9/02 29/889.2 |
| 2009/0313823 | A1 * | 12/2009 | Rockstroh | B23P 6/007 29/889.1 |
| 2010/0061863 | A1 | 3/2010 | Delvaux et al. | |

OTHER PUBLICATIONS

Supplementary European Search Report and Communication; Application No. 138728662-1362/2943656; Dated Jul. 20, 2016; 8 pages.

* cited by examiner

DMZ FRACTURE BOUNDARY LIMIT

FIELD OF THE DISCLOSURE

The present disclosure relates generally to material improvement processes and, more particularly, to methods for identifying parameters for material improvement processes.

BACKGROUND OF THE DISCLOSURE

Gas turbine engines typically include a compressor, a combustor, and a turbine, with an annular flow path extending axially through each. Initially, air flows through the compressor where it is compressed or pressurized. The combustor then mixes and ignites the compressed air with fuel, generating hot combustion gases. These hot combustion gases are then directed from the combustor to the turbine where power is extracted from the hot gases by causing blades of the turbine to rotate.

Various parts of the gas turbine engine, such as compressor rotor blades, are susceptible to cracking from stress, fatigue and damage (e.g. foreign object debris). This damage can reduce the life of the part, requiring repair or replacement. To protect parts from crack initiation and propagation, residual compressive stresses can be imparted into the part by a material improvement process, such as shot peening, laser shock peening (LSP), pinch peening, and low plasticity burnishing (LPB). Accordingly, there exists a need for a method of identifying parameters for the material improvement process on the part.

SUMMARY OF THE DISCLOSURE

According to one embodiment of the present disclosure, a method of establishing a boundary for a material improvement process on a workpiece is disclosed. The method may comprise identifying a maximum allowable damage depth on the workpiece; identifying a maximum constant thickness line on the workpiece at an extent of the maximum allowable damage depth; identifying a peak vibratory stress gradient on the workpiece; identifying a peak combined engine stress on the workpiece; and specifying the boundary for the material improvement process on the workpiece relative to the maximum constant thickness line, peak vibratory stress gradient, and peak combined engine stress.

In a refinement, the method may further comprise checking the boundary relative to the peak combined engine stress.

In another refinement, the method may further comprise setting the boundary for the material improvement process such that it bypasses the peak vibratory stress gradient.

In another refinement, the method may further comprise identifying the peak combined engine stress along the maximum constant thickness line.

In another refinement, the method may further comprise performing the material improvement process on the workpiece up to the boundary.

In yet another refinement, the method may further comprise performing laser shock peening on the workpiece up to the boundary.

According to another embodiment of the present disclosure, a method of specifying a boundary for a material improvement process on an airfoil having a leading edge, a trailing edge downstream of the leading edge, a tip, and a base, is disclosed. The method may comprise identifying a maximum allowable damage depth from the leading edge of the airfoil; identifying a maximum constant thickness line at the maximum allowable damage depth, the constant thickness line extending from the base of the airfoil to the tip of the airfoil; identifying a peak vibratory stress gradient on the airfoil; identifying a peak combined engine stress along the maximum constant thickness line based in part on the peak vibratory stress gradient; and specifying a boundary of the material improvement process relative to the maximum allowable damage depth, maximum constant thickness line, peak vibratory stress gradient, and peak combined engine stress on the airfoil.

In a refinement, the method may further comprise specifying the boundary does not pass through the peak vibratory stress gradient.

In a related refinement, the method may further comprise re-assessing the peak combined engine stress in relation to the boundary.

In a related refinement, the method may further comprise re-specifying the boundary if the boundary is upstream of the peak combined engine stress.

In another refinement, the method may further comprise identifying the boundary from the tip of the airfoil to the base of the airfoil in a nonlinear configuration.

In another refinement, the method may further comprise specifying the boundary is downstream of the maximum constant thickness line.

In another refinement, the method may further comprise selecting an area for the material improvement process from the leading edge of the airfoil to the boundary.

In a related refinement, the method may further comprise performing the material improvement process on the selected area.

In a related refinement, the method may further comprise performing laser shock peening on the selected area.

According to yet another embodiment of the present disclosure, an airfoil for a gas turbine engine is disclosed. The airfoil may comprise a pair of opposing sides extending from a leading edge to a trailing edge and extending radially from a base to a tip, and at least one processed patch extending from the leading edge to a boundary extending from the base to the tip, the boundary positioned in relation to a maximum allowable damage depth, a maximum constant thickness line at an extent of the maximum allowable damage depth, a peak vibratory stress gradient, and a peak combined engine stress on the airfoil.

In a refinement, the boundary may be specified downstream of the maximum allowable damage depth.

In another refinement, the boundary may be specified downstream of the maximum constant thickness line and downstream of a peak combined engine stress.

In another refinement, the boundary may be specified upstream of and circumventing the peak vibratory stress gradient.

In another refinement, the at least one processed patch may be processed by laser shock peening.

These and other aspects and features of the disclosure will become more readily apparent upon reading the following detailed description when taken in conjunction with the accompanying drawings. Although various features are disclosed in relation to specific exemplary embodiments of the invention, it is understood that the various features may be combined with each other, or used alone, with any of the various exemplary embodiments of the invention without departing from the scope of the invention.

While the present disclosure is susceptible to various modifications and alternative constructions, certain illustrative embodiments thereof, will be shown and described below in detail. It should be understood, however, that there is no intention to be limited to the specific embodiments disclosed, but on the contrary, the intention is to cover all modifications, alternative constructions, and equivalents along within the spirit and scope of the present disclosure.

DETAILED DESCRIPTION

Figure 1:
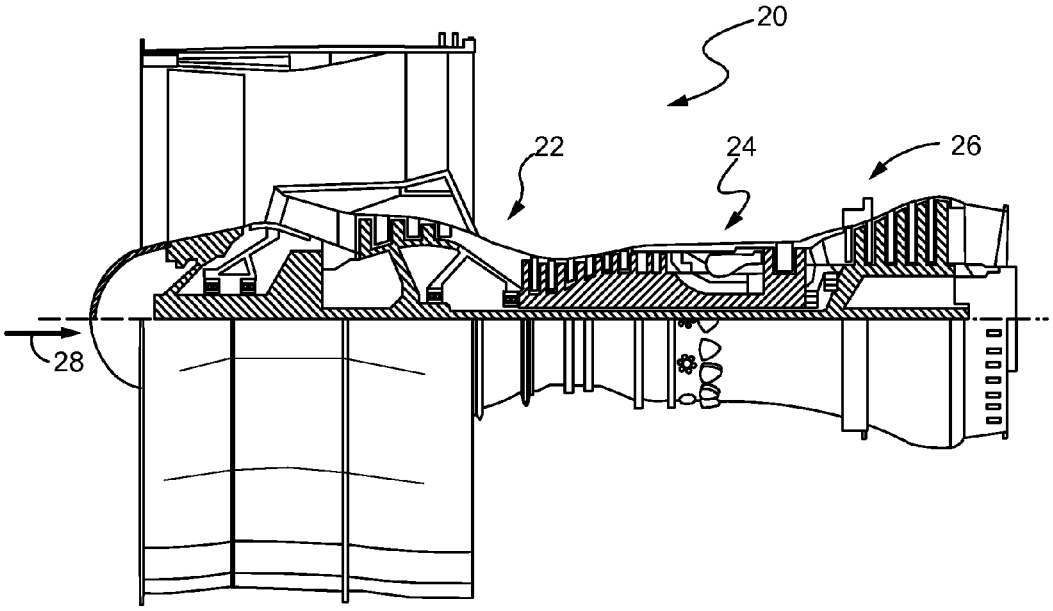
FIG. 1 is a cross-sectional view of a gas turbine engine according to one embodiment of the present disclosure.

Referring now to the drawings, and with specific reference to FIG. 1, in accordance with the teachings of the disclosure, an exemplary gas turbine engine 20 is shown. The gas turbine engine 20 may generally comprise a compressor section 22 where air is pressurized, a combustor 24 downstream of the compressor section which mixes and ignites the compressed air with fuel and thereby generates hot combustion gases, a turbine section 26 downstream of the combustor 24 for extracting power from the hot combustion gases, and an annular flow path 28 extending axially through each.

Figure 2:
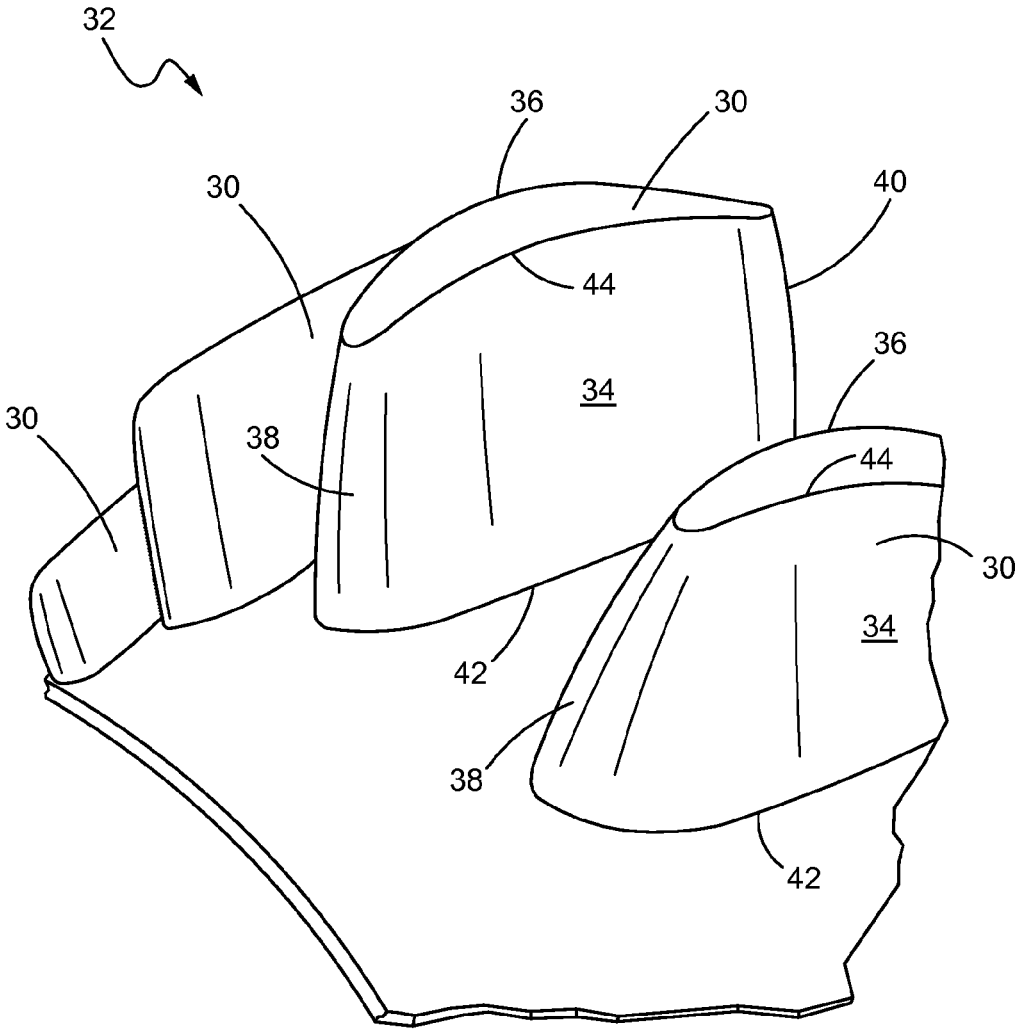
FIG. 2 is a perspective view of an airfoil array of the gas turbine engine of FIG. 1.
Figure 3:
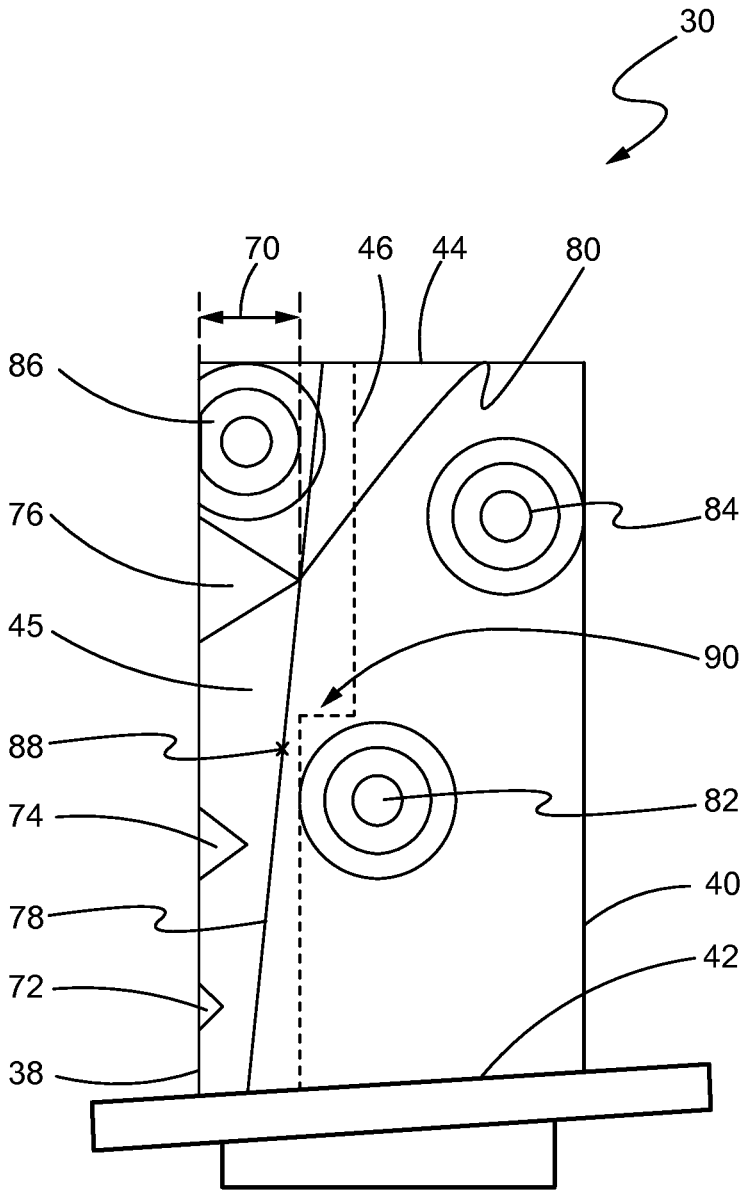
FIG. 3 is a front view of an airfoil of the gas turbine engine of FIG. 1.

Turning now to FIGS. 2 and 3, an exemplary airfoil 30 of the compressor section 22 or turbine section 26 is shown. An array 32 of airfoils 30 may include multiple airfoils along with a platform, as a stage of rotor blades or stator vanes in the compressor section 22 or the turbine section 26 of the gas turbine engine.

The airfoil 30 may comprise a pair of opposing sides 34, 36 extending from a leading edge 38 to a trailing edge 40 (downstream of the leading edge 38) and extending radially from a base 42 to a tip 44. A material improvement process may be performed on the airfoil 30 to impart residual compressive stresses into the airfoil 30, thereby protecting the airfoil 30 from crack initiation and propagation. Examples of such material improvement processes include, but are not limited to, shot peening, laser shock peening (LSP), pinch peening, or low plasticity burnishing (LPB).

As shown best in FIG. 3, the material improvement process may be performed on at least one patch 45. The patch 45 of the airfoil 30 is the area on the airfoil 30 where the residual compressive stresses are imparted by the material improvement process. The patch 45 may be on either or both sides 34, 36 of the airfoil 30, and may comprise an area extending from the base 42 to the tip 44 and extending from the leading edge 38 up to a boundary 46, which delineates a limit or an extent of treatment by the material improvement process. In order to establish the boundary 46 of the patch, a variety of parameters on the airfoil 30 must be identified, as further explained below.

Figure 4:
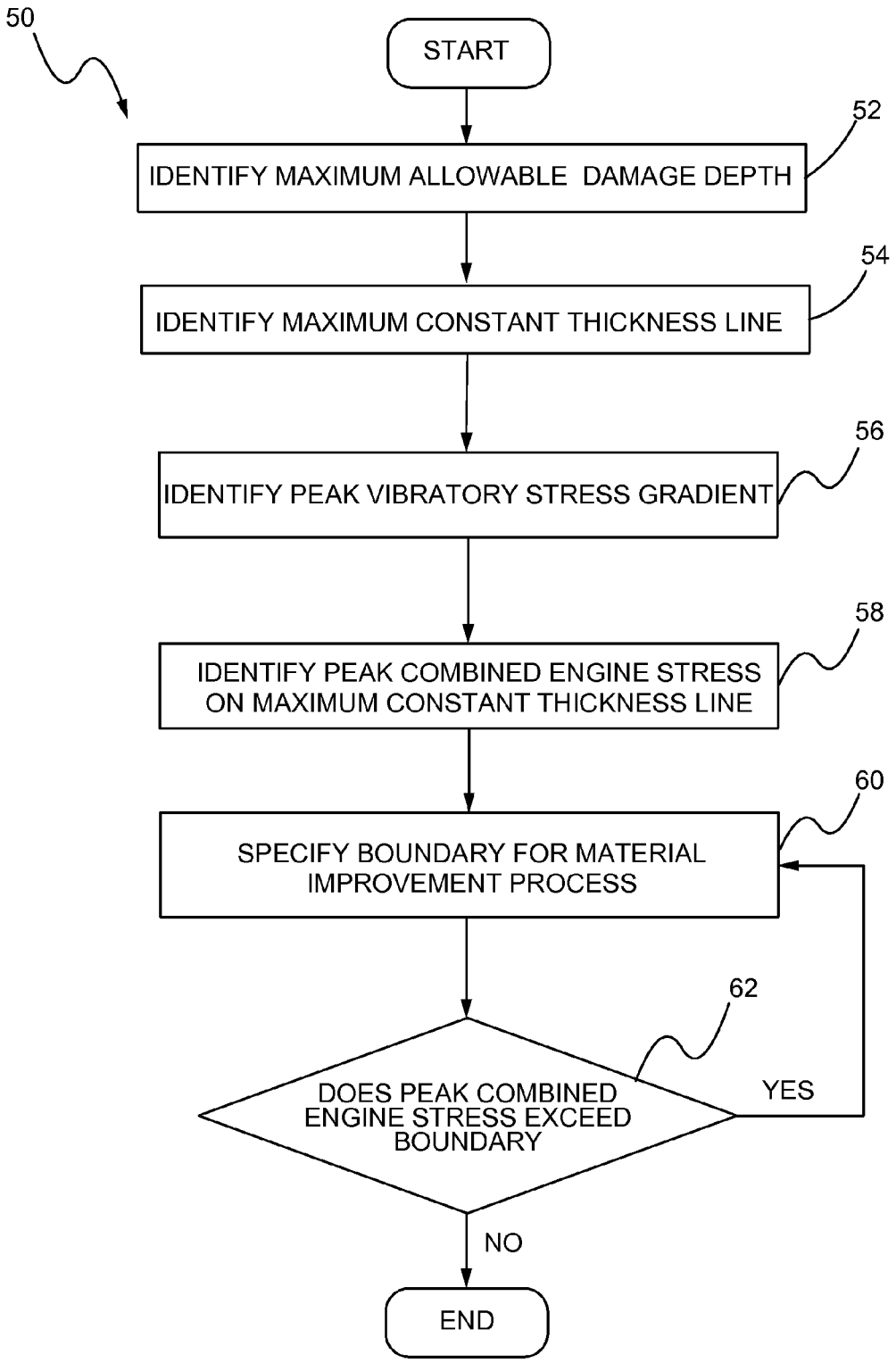
FIG. 4 is a flowchart outlining a method of establishing a boundary for a material improvement process on the airfoil of FIG. 3, according to an embodiment of the present disclosure.

Turning to FIG. 4, with continuing reference to FIG. 3, a flowchart is shown outlining one method 50 for establishing the boundary 46 of the material improvement process. At a first step 52, a maximum allowable damage depth 70 is identified. The maximum allowable damage depth 70 is the depth of the maximum damage that is allowable on the airfoil 30 without causing failure (such as breaking) of the airfoil. For example, damage due to foreign object debris may be allowed on the airfoil 30, as long as the airfoil does not completely fail (or break-off of the base 42). Allowable damage 72, 74, 76, is shown in FIG. 3 as notches or dents. The maximum allowable damage depth 70 is referenced from the leading edge 38 of the airfoil 30. Based on the exemplary airfoil 30 in FIG. 3, the maximum allowable damage depth 70 would then be the distance from the leading edge 38 to the farthest extending of notches 72, 74, 76, which, in this case, is the depth of notch 76, since notch 76 is the largest of the three exemplary notches 72, 74, 76.

At a next step 54, a maximum constant thickness line 78 associated with the maximum allowable damage depth 70 is identified. The maximum constant thickness line 78 may be identified from the base 42 of the airfoil 30 to the tip 44 of the airfoil 30 at a constant thickness of the maximum allowable damage depth 70. The maximum constant thickness line 78 indicates a line on the airfoil 30 from base 42 to tip 44 that has substantially constant thickness along the line 78. In the exemplary airfoil of FIG. 3, the thickness along the maximum constant thickness line 78 would be the same thickness as at the end 80 of notch 76, which is the maximum allowable damage depth 70 as described above. It will be understood that although in FIG. 3, the maximum constant thickness line 78 is a straight line, the maximum constant thickness line 78 may not be straight depending on the cross-sectional profile of the airfoil 30.

At a next step 56, a peak vibratory stress gradient is identified. The airfoil 30 may have different vibratory stress gradients 82, 84, 86 that are inherent to the airfoil 30 during engine operation. When the tensile component of the vibratory stress gradients combines with the material improvement process's compensatory tensile stress, the combined stress may exceed the material capability of the airfoil for withstanding high cycle fatigue, which may lead to significant failure (i.e., cracking or breaking) of the airfoil. Therefore, the peak vibratory stress gradient is identified in order to establish the boundary of the material improvement process that will prevent failure of the airfoil. In the exemplary airfoil 30 of FIG. 3, out of the three vibratory stress gradients 82, 84, 86, the peak vibratory stress gradient would be gradient 82 because it is located in a tensile zone of the airfoil 30. Vibratory stress gradients 84 and 86 are not located in the tensile zone of the airfoil 30, and are therefore, insignificant because they would not lead to failure of the airfoil. It will be understood that the airfoil 30 in FIG. 3 is an example only and that the vibratory stress gradients and peak vibratory stress gradients may vary depending on the individual airfoil and the individual airfoil's tensile zone.

At a next step 58, a peak combined engine stress is identified along the maximum constant thickness line 78. The combined engine stress is equal to the centripetal stress from the engine during operation added to the vibratory stress of the airfoil. The peak combined engine stress is the area along maximum constant thickness line 78 that has the highest combined engine stress. In the exemplary airfoil 30 of FIG. 3, along maximum constant thickness line 78, the peak combined engine stress would be at location 88, in part because of the peak vibratory stress gradient 82 identified above.

At step 60, the boundary 46 is established. After identifying the different parameters of the maximum allowable damage depth 70, the maximum constant thickness line 78, the peak vibratory stress gradient 82, and the peak combined engine stress 88, the boundary 46 is specified taking these parameters in consideration. Since the material improvement process is applied to both sides 34, 36 of the airfoil 30 from the leading edge 38 up to the boundary 46, compressive stresses are imparted upstream of the boundary but not downstream of the boundary. Therefore, the total combined stress on the airfoil, which includes the above identified parameters, is assessed. The total combined stress is the combined engine stress plus the compressive stress associated with the material improvement process. For example, in FIG. 3, the boundary 46 is downstream of the maximum allowable damage depth 70, downstream of the maximum constant thickness line 78, downstream of the peak combined engine stress 88. In so doing, compressive stresses will be imparted through the material improvement process to the patch 45 which is upstream of the boundary 46. Thus, the compressive stress from the material improvement process will strengthen the airfoil 30 specifically including the areas of the maximum allowable damage depth 70, the maximum constant thickness line 78 and the peak combined engine stress 88.

At the same time, the boundary 46 is upstream of the peak vibratory stress gradient 82. In so doing, no compressive stress will be imparted (via the material improvement process) to the peak vibratory stress gradient 82. This is desirable considering that imparting compressive stress to the peak vibratory stress gradient 82 on the airfoil 30 may lead to significant failure (i.e., cracking or breaking) of the airfoil. Therefore, the boundary 46 may specifically be established such that it does not pass through the peak vibratory stress gradient 82. More specifically, as shown in FIG. 3, a portion 90 of the boundary 46 may bypass or circumvent the significant stress area 82, resulting in a nonlinear configuration of the boundary 46.

At a final step 62, a final check of the boundary 46 is performed. More specifically, the peak combined engine stress 88 is re-assessed in relation to the boundary 46 to ensure that the peak combined engine stress 88 does not exceed the propagation allowable set by the boundary 46. If the total combined stress exceeds the stress necessary for crack propagation, then the boundary has to be re-established. For example, hypothetically, if the boundary 46 were upstream of the peak combined engine stress 88, the boundary would have to be re-specified to ensure the boundary 46 is downstream of the peak combined engine stress 88. Since the material improvement process will be performed on the patch 45 upstream to the boundary 46, if the boundary 46 were upstream to the peak combined engine stress 88, then the area on the airfoil 30 of the peak combined engine stress 88 would not receive treatment of the material improvement process, and therefore, crack propagation at the point of the peak combined engine stress 88 could lead to damage or breaking of the airfoil 30. On the other hand, if the peak combined engine stress 88 is within the patch to be treated by the material improvement process, or as shown in FIG. 3, the boundary 46 is downstream of the peak combined engine stress 88, then the method 50 is at an end.

It will be understood that although the method 50 is shown and described for an airfoil, it may be applied to any workpiece being treated by a material improvement process without departing from the scope of the disclosure.

INDUSTRIAL APPLICABILITY

From the foregoing, it can be seen that the teachings of this disclosure can find industrial application in any number of different situations, including but not limited to, gas turbine engines. Such engines may be used, for example, on aircraft for generating thrust, or in land, marine, or aircraft applications for generating power.

The disclosure described provides a method of identifying parameters for a material improvement process. By applying the disclosed method to a gas turbine engine airfoil, or other metallic part, critical parameters for the material improvement process are identified and specified. This results in a more effective treatment of the material improvement process on the gas turbine engine airfoil, which thereby leads to a more durable and longer-lasting part. Furthermore, the benefits of the material improvement process, such as shot peening, laser shock peening (LSP), pinch peening, low plasticity burnishing (LPB), or other material improvement process, can be obtained at a substantially reduced cost.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto.

What is claimed is:

1. A method of performing a material improvement process on a workpiece, comprising:

identifying a maximum allowable damage depth on the workpiece;

identifying a maximum constant thickness line on the workpiece at an extent of the maximum allowable damage depth, the maximum constant thickness line extending from a base of the workpiece to a tip of the workpiece opposite the base;

identifying a peak vibratory stress gradient on the workpiece;

identifying a peak combined engine stress on the workpiece;

specifying the boundary for the material improvement process on the workpiece relative to the maximum constant thickness line, peak vibratory stress gradient, and peak combined engine stress; and performing a material process on the workpiece in a portion of the workpiece defined by the boundary.

2. The method of claim 1, further comprising checking the boundary relative to the peak combined engine stress.

3. The method of claim 1, further comprising setting the boundary for the material improvement process such that it bypasses the peak vibratory stress gradient.

4. The method of claim 1, further comprising identifying the peak combined engine stress along the maximum constant thickness line.

5. The method of claim 1, further comprising performing laser shock peening on the workpiece up to the boundary.

6. A method of forming an airfoil, the method comprising:

defining a leading edge of the airfoil, and a trailing edge of the airfoil edge downstream of the leading edge of the airfoil;

defining a base of the airfoil, and a tip of the airfoil opposite the base of the airfoil;

identifying a maximum allowable damage depth from the leading edge of the airfoil;

identifying a maximum constant thickness line at the maximum allowable damage depth, the constant thickness line extending from the base of the airfoil to the tip of the airfoil;

identifying a peak vibratory stress gradient on the airfoil;

identifying a peak combined engine stress along the maximum constant thickness line based in part on the peak vibratory stress gradient;

specifying a boundary of the material improvement process relative to the maximum allowable damage depth, maximum constant thickness line, peak vibratory stress gradient, and peak combined engine stress airfoil;

defining an area for application of a material improvement process between the leading edge of the airfoil and the boundary; and performing the material improvement process at the defined area.

7. The method of claim 6, further comprising specifying the boundary does not pass though the peak vibratory stress gradient.

8. The method of claim 7, further comprising re-assessing the peak combined engine stress in relation to the boundary.

9. The method of claim 8, further comprising re-specifying the boundary if the boundary is upstream of the peak combined stress engine.

10. The method of claim 6, further comprising identifying the boundary from the tip of the airfoil to the base of the airfoil in a nonlinear configuration.

11. The method of claim 6, further comprising specifying the boundary is downstream of the maximum constant thickness line.

12. The method of claim 6, further comprising performing laser shock peening on the selected area.

13. An airfoil for a gas turbine engine comprising:

a pair of opposing sides extending from the leading edge to a trailing edge and extending radially from a base to a tip; and at least one processed patch extending from the leading edge to a boundary extending from the base to the tip, the boundary positioned in relation to a maximum allowable damage depth, a maximum constant thickness line extending from the base to the tip at an extent of the maximum allowable damage depth, a peak vibratory stress gradient, and a peak combined engine stress on the airfoil.

14. The airfoil of claim 13, wherein the boundary is specified downstream of the maximum allowable damage depth.

15. The airfoil of claim 13, wherein the boundary is specified downstream of the maximum constant thickness line and downstream of the peak combined engine stress.

16. The airfoil of claim 13, wherein the boundary is specified upstream of and circumventing the peak vibratory stress gradient.

17. The airfoil of claim 13, wherein the at least one processed patch is processed by laser shock peening.

* * * * *